US010337237B2

(12) United States Patent
Malluck

(10) Patent No.: US 10,337,237 B2
(45) Date of Patent: Jul. 2, 2019

(54) ACOUSTICAL SEAL SYSTEM FOR DOORS

(71) Applicant: DISNEY ENTERPRISES, INC., Burbank, CA (US)

(72) Inventor: John Andrew Malluck, Valencia, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 269 days.

(21) Appl. No.: 15/426,778

(22) Filed: Feb. 7, 2017

(65) Prior Publication Data

US 2018/0223592 A1 Aug. 9, 2018

(51) Int. Cl.

| | |
|---|---|
| ***E06B 5/20*** | (2006.01) |
| ***E06B 1/16*** | (2006.01) |
| ***E06B 7/24*** | (2006.01) |
| ***E06B 3/263*** | (2006.01) |
| *E06B 5/00* | (2006.01) |
| *E06B 1/28* | (2006.01) |

(52) U.S. Cl.

CPC ..... *E06B 5/20* (2013.01); *E06B 1/16* (2013.01); *E06B 3/26343* (2013.01); *E06B 7/24* (2013.01); *E06B 3/263* (2013.01)

(58) Field of Classification Search

CPC ... E06B 5/20; E06B 5/205; E06B 1/16; E06B 1/28; E06B 1/325; E06B 3/26301; E06B 3/26303; E06B 3/26321; E06B 3/26343

See application file for complete search history.

(56) References Cited

U.S. PATENT DOCUMENTS 3,319,738 A * 5/1967 Wehe, Jr. ..... E06B 5/20 181/290
3,773,140 A * 11/1973 Mahajan ..... G10K 11/16 181/200
4,910,920 A * 3/1990 Nichols ..... H05K 9/0016 174/361
4,924,969 A * 5/1990 L'Heureux ..... E06B 5/20 181/287
5,371,987 A * 12/1994 Hirsch ..... E06B 1/045 49/239
5,777,279 A * 7/1998 Parker ..... G10K 11/162 181/287

(Continued)

FOREIGN PATENT DOCUMENTS

DE 2523377 A1 * 12/1976 ..... E04B 2/7409

*Primary Examiner* — Edgardo San Martin
(74) *Attorney, Agent, or Firm* — Marsh Fischmann & Breyfogle LLP; Kent A. Lembke

(57) ABSTRACT

An acoustical seal system that utilizes a sound absorbing material-based sound seal for the gap or flanking path between a closed door and the nearby surfaces (e.g., the door jam or frame and the floor). When the door is in a closed position, the acoustical seal system may leave a small gap around the door so that the door does not have to make contact with the surrounding structural components. The small gap is an air passage between the two adjacent rooms. The acoustical seal system includes a housing with one or more cavities. The housing is mounted on the sides of the door core or body or on the surrounding components such that the cavities face the small air gap when the door is in the closed position. The cavities are filled with sound-absorbing material, such as an acoustical foam, that is exposed to the air gap.

31 Claims, 7 Drawing Sheets

(56) References Cited

U.S. PATENT DOCUMENTS

| | | | | |
|---|---|---|---|---|
| 6,519,899 | B1 * | 2/2003 | Hurzeler | E06B 5/18<br>174/374 |
| 7,117,640 | B2 * | 10/2006 | Hurzeler | E06B 5/18<br>49/501 |
| 8,176,682 | B2 * | 5/2012 | Gaviglia | E06B 5/18<br>49/400 |
| 9,359,810 | B2 * | 6/2016 | Baumert | E06B 5/164 |
| 2015/0345131 | A9 * | 12/2015 | Ariza | E04B 2/828<br>52/238.1 |

* cited by examiner

ACOUSTICAL SEAL SYSTEM FOR DOORS

BACKGROUND

1. Field of the Description

The present description relates, in general, to acoustical seals and sound absorption and, more particularly, to a system or assembly for providing an acoustical seal that is at least partially provided in some embodiments as a non-contact sound seal for a door, while other embodiments may have some contacting seals such that the acoustic seal system may be thought of more generally as a sound seal with an absorptive portion or arrangement.

2. Relevant Background

There are numerous settings where it is desirable to provide a door between two rooms (or spaces) and to also try to limit the amount of sound that travels between the two rooms when the doors are shut. For example, venues that have multiple rooms in which different scenes or parts of a show or story are presented as well as multi-auditorium theaters. The rooms are separated from one another with architectural walls and doors that allow ingress and egress to the room. The walls and doors are important to limit audio transfer between the rooms when the doors are closed.

Sound leaking between rooms at doors can be a serious problem that can be difficult to adequately address. The doors themselves may be fabricated to absorb sound and to block its leakage between two rooms, but sound may still leak or propagate around the doors via the gaps or "flanking paths" between the door's sides or edges and the surrounding door frame, structural wall, or floor. Audio leaking from entertainment presented in other rooms or adjacent lobby and concession spaces through the door or its flanking paths can undesirably intrude on the intended audio and distract the audience.

To limit sound leakage through the flanking paths or gaps around a door, acoustical engineers presently use contact (or contacting) acoustic seals. In brief, these acoustic seals are designed to provide an airtight seal to prevent sound from transferring in the space or gap between the door and the door frame and floor. Some contact-based acoustic seals include a compressible and resilient bulb (e.g., a rubber gasket) that is provided along the sides of the door frame and in the bottom edge of the door (or on the floor) to provide sound control. Each time the door is closed the bulb or rubber gasket contacts surfaces of the door (or the floor) to provide an airtight seal that acts as a very effective sound barrier.

The manufacturers of these gap-sealing solutions teach that gaps in sound barriers are a major problem because sound travels through any opening with very little loss. Even a very small hole in the contact-based seal or bulb/gasket transmits almost as much sound as a much larger gap. With this characteristic of sound in mind, the gasket manufacturers teach that any unsealed gaps effectively cancel out the noise reduction benefits of even the highest-rated sound doors and to be effective, acoustical door assemblies require the contact-based gasketing to work to provide a complete, uninterrupted, and air-tight seal around the door (i.e., conventional wisdom in the field of acoustic engineering is that if all sides of the door are not sealed the gasketing used will provide little or no sound control value).

When properly installed and maintained, these contact-based acoustic seals or gasketing systems provide an acceptable solution to the problem of sound leakage. Unfortunately, though, these acoustic seals rely on their ability to achieve an airtight coupling in the flanking path to be effective, and, over time, most of these contact-based seals will deteriorate in their ability to achieve the airtight seal and often will simply fail or break with continued use.

Hence, there remains a need for a design for an acoustic seal for ride-action doors that acts as a useful sound barrier. The new seals need to be durable even when the doors are opened frequently and need to be easy to maintain.

SUMMARY

Briefly, an acoustical seal system or assembly is described that utilizes a non-contact sound seal for at least a portion of the gap or flanking path between a closed door and the nearby surfaces (e.g., the door jam or frame and the floor). Note, some embodiments may include a contact or contacting portion as well such that the use of the term "non-contact" is not intended to limit the acoustical seal system to systems free of all contact or contacting seals, and the new system may be thought of as a system that utilizes a sound absorptive arrangement rather than being a non-contact system. The new acoustical seal system provides an acoustical sealing arrangement that is particularly well suited for use with a door as it absorbs and reduces objectionable sound leakage between two rooms connected by the door.

When the door for which the acoustical seal system is provided is in a closed position, the acoustical seal system leaves a small gap around the door (at least in a portion of the flanking path) so that the door does not make or at least does not require contact with the surrounding structural components or entities. These surrounding components/entities may include a door frame, the floor, and an adjacent door. The small gap has air in it and, therefore, forms an air passage between the two adjacent rooms or spaces joined by a door.

The acoustical seal system includes a frame or body with one or more receptacles, recessed surfaces, or cavities. The frame or body is mounted on the sides/edges of the body of the door (e.g., is embedded in the door) and/or on the surrounding components/entities such that the one or more receptacles, recessed surfaces, or cavities are adjacent to and face the small air gap when the door is in the closed position. In other words, the frame/body of the acoustic seal system defines at least one side of the air gap or passageway around the closed door. Each of the receptacles, recessed surfaces, or cavities is filled with or contains sound-absorbing material (e.g., an acoustical foam such as commercially-available open cell foam) that is exposed to the air gap or passageway (or the sound-absorbing material can be thought of as providing one of the surfaces defining the air gap or passageway).

In use and with the door closed, the acoustic seal system works by allowing audio or sound from one of the rooms to enter the air gap or passageway. Since the gap is small (e.g., less than 0.25 inches in size), only a small quantity of sound enters the gap or passageway. This sound is traveling in the flanking path around the door toward the other or second room. However, as the sound travels toward the second room in the air gap or passageway, the sound absorption material in the cavities captures or absorbs a fraction or portion of the sound such that only a small quantity enters the second room. The acoustic seal system may include four or more of the bodies or frames that contain the sound absorbing materials, and these bodies/frames can be positioned near or applied to each of the four outside edges/sides of the door to provide a useful sound barrier when the door between two adjacent rooms/spaces is in the closed position as the entire flanking path will be faced with sound absorbing material. Note, also, that some embodiments may have the seal system applied to less than all four edges such as along one, two, or three of the four edges of a door.

More particularly, a door assembly is provided that is adapted for sound absorption about its flanking path(s). The assembly includes a door (pivotally, slidingly/slidably, or otherwise) supported on a wall to be positionable in an opened position and in a closed position. The assembly also includes a door frame including: (a) an upper member extending along an upper side of the door between the wall and the upper side of the door; and (b) a side member extending along an outer side of the door between the wall and the outer side of the door. The door assembly further includes an acoustical seal system to provide sound absorption. The acoustical seal system includes: (a) a first air passageway between the upper member of the door frame and the upper side of the door; (b) a second air passageway between the side member of the door frame and the outer side of the door; (c) a first housing in at least one of the upper member of the door frame and the upper side of the door, with the first housing including a cavity in fluid communication with the first air passageway; (d) a second housing in at least one of the side member of the door frame and the outer side of the door, with the second housing including a cavity in fluid communication with the second air passageway; (e) a first volume of sound absorbing material positioned in the cavity of the first housing; and (f) a second volume of sound absorbing material positioned in the cavity of the second housing.

In some embodiments, the sound absorbing material is at least one of open cell (acoustical) foam, fiberglass wool, mineral wool (rockwool), sprayed cellulose, aramid wool, cementitous wood fiber, and acoustical plaster. In the same or other embodiments, the first and second air passageways have a depth as measured orthogonal from the sound absorbing material of less than about 0.25 inches. The first cavity may have a length as measured along a longitudinal axis of the upper side of the door that is greater than one half of a length of the first air passageway, and, likewise, the second cavity may have a length as measured along a longitudinal axis of the outer side of the door that is greater than one half of a length of the second air passageway. The first and second cavities each may have a depth that is greater than 0.25 inches, such as a depth greater than about 2 inches. In practice, the acoustical seal system generates additional sound transmission losses for the entire door assembly in the range of 4 to 8 decibels (dBs) (e.g., 6 to 8 or more dBs) compared to a non-sound absorptive passageway. A door having an air passage along two edges can achieve an ASTM E336 sound transmission class (STC) of 24 for the entire door assembly, assuming the air passage is open to both rooms and without sound absorbing material in place. Adding the cavity and sound absorptive features to the two air passages improves the door assembly STC to over 30. To this end, each of the first and second cavities may include two or more spaced-apart dividing walls (or "fingers") each with a solid body dividing the sound absorbing material into three or more volumes or pieces (e.g., dividing the single larger cavity into three or more subcavities or recessed surfaces each containing some of the sound absorbing material).

In some embodiments, the second housing is provided in the door frame, and the door assembly also includes a third housing in the outer side of the door with a cavity, containing sound absorbing material, in fluid communication with the second air passageway. In other embodiments, the door assembly also includes a third housing mounted to a lower side of the door. In these embodiments, the third housing comprises at least one cavity filled with a volume of sound absorbing material and the cavity faces a third air passageway between the door and a floor below the door.

In some implementations, the door assembly further includes a second door pivotally mounted to the wall to be positionable in a closed position whereby an inner side of the second door faces an inner side of the door with a third air passageway between the door and the second door. In such implementations, at least one of the inner sides of the door and second door includes a cavity, filled with sound absorbing material, that is in fluid communication with the third air passageway. In some cases, it may be desirable to include a mix of non-contact sealing with conventional contact-based sealing, and, in such cases, the door assembly may include, adjacent to the cavity in the first or second housing, a contact-type acoustic seal member providing an airtight seal of the first or second air passageway with the door in the closed position.

With this particular embodiment(s) in mind, it may be useful to provide an additional overview or summary of the new acoustical system prior to turning to additional exemplary embodiments and the supporting figures. In general, the acoustical seal system involves a wall or other physical partition separating two rooms. Within the wall is an opening where a door is housed. The door can be moved into an open or closed position either by a pivoting hinge or by sliding or any other movable mechanisms/technologies. Other movable mechanisms for example could be a door movably installed on a track, moveably installed on hung wire, or moveably installed on lever arms.

Surrounding entities are positioned adjacent to the door when it lies in a closed position. Surrounding entities include a door jamb or door frame or could be the wall or partition itself. The door jamb and door frame in many cases would be attached to the wall or partition. Surrounding entities also include the floor of the room or a second adjacent door, which may also occupy the same opening in the wall.

When the door is in the closed position there exists a small gap between the door and the surrounding entities. The small gap forms a passageway between the door and the surrounding entities. One side of the passageway is formed by the portion of the door facing the surrounding entities. The other side is formed by the portion of the surrounding entities facing the door. For some embodiments the passageway may be an unobstructed passageway between the two rooms. Other embodiments may have passageways obstructed by additional features such as brush seals or contacting elements.

The acoustical sealing system has one or more cavities embedded either within the body of the door or within the surrounding entities such that the cavities are open to the passageway. The cavity can be a recessed surface or a plurality of recessed surfaces resembling receptacles. Generally, the cavities may have a depth from 0.25 to 8 inches. The cavities of the sealing system are substantially filled with sound absorbing material. Sound absorbing materials include: (a) mineral wool (or rockwool), such as Roxul RXL 60 RockBoard (6 lbs/ft$^3$); (b) fiberglass wool, such as Owens Corning SelectSound Black Acoustic Board (3.0 lbs/ft$^3$); (c) open cell (acoustical) foam such as BASF Basotect foam (0.6 lbs/ft$^3$) or Acoustical Surfaces Inc. Sound Silencer Polypropylene foam; (d) cotton wool, such as UltraTouch Denim Insulation; (e) sprayed cellulose, such as International Cellulose incorporated K-13 insulation; (f) aramid wool, such as Textech industries MC8-4591B blanket; (g) cementitious wood fiber, such as Tectum Inc.'s interior panels; and (h) acoustical plaster, such as Pyrok Inc. Acoustement 40 or Baswa Acoustic LLC's Phon. Appropriate sound absorbing materials will have been tested according to ASTM C423 and will achieve a noise reduction coefficient (NRC) of 0.5 or greater.

The cavity may also have an acoustically transparent facing applied, which serves to protect the sound absorbing material from abrasion. Acoustically transparent facings include perforated rigid sheet or rigid screen material. Perforated rigid sheets preferably have an open area of at least 12% but more preferably should be open at least 20% to effectively allow high frequency sound transfer. The cavity may also have rigid or semi rigid boundary walls to divide the cavity. These can be made from a rigid material such as steel or aluminum or from a semi-rigid material such as mass-loaded vinyl or neoprene.

DETAILED DESCRIPTION

Briefly, the following description provides embodiments of an acoustic seal system that may be implemented to provide a sound absorption in the flanking path of a door. The acoustic seal system differs from prior seal products in that it does not require a contact or an airtight seal to be effective. Instead, each acoustic seal system embodiment includes at least a portion or length in which an air passage or gap is provided between the door's surfaces (sides/edges) and the surrounding structure (e.g., a door frame, a floor, or the other door in a pair of swinging doors). The acoustic seal system is configured to place a volume of a sound absorbing material along this air passage or gap that acts to effectively reduce the amount of sound that is transferred through the gap/air passage (or its flanking path). In some embodiments, for example, an ASTM E413/E90 sound transmission class (STC) of 35 is achieved, which provides an adequate sound barrier between two rooms or spaces joined by the door(s).

Figure 1:
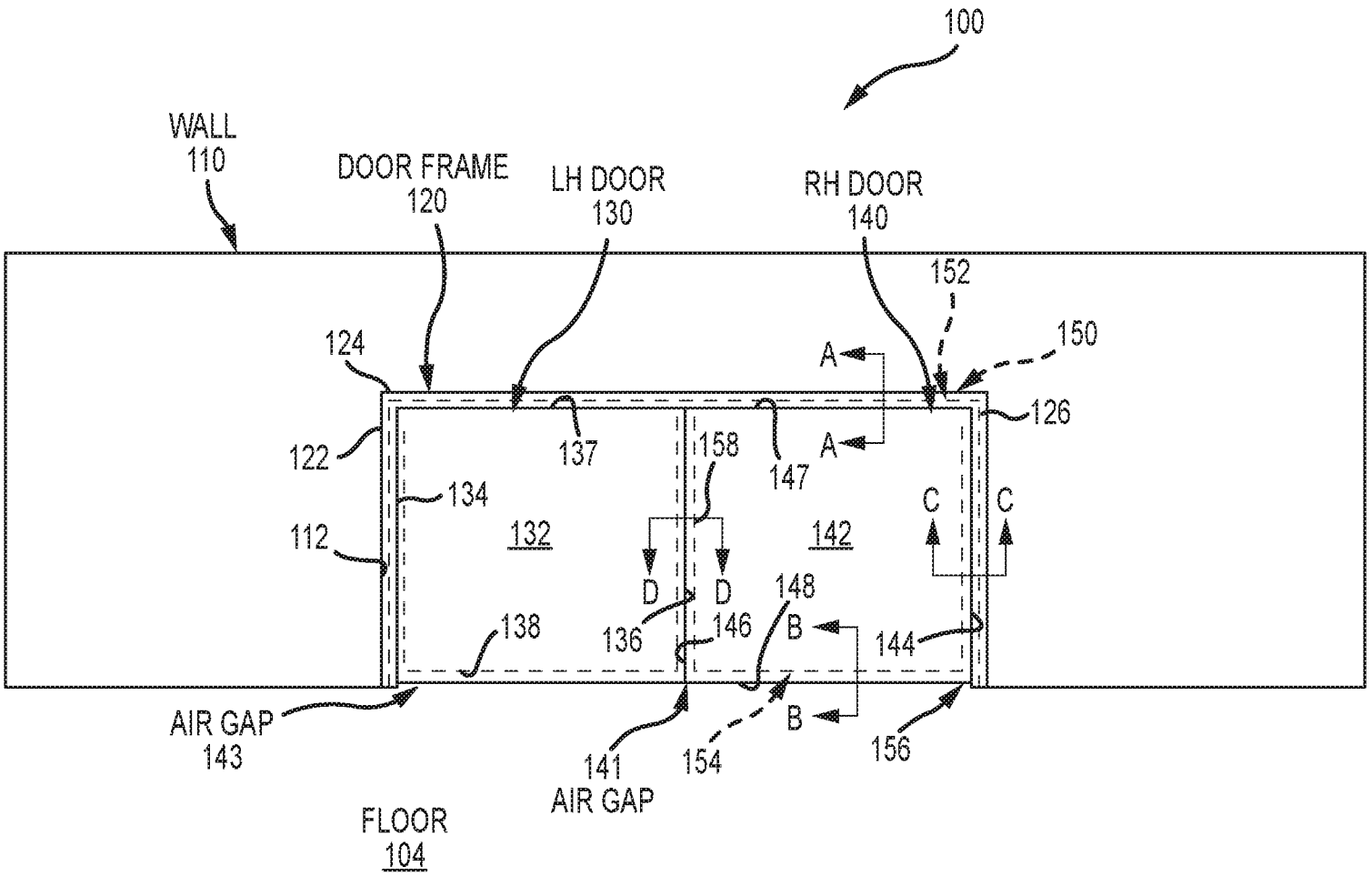
FIG. 1 illustrates a door assembly including an exemplary embodiment of an acoustic seal system of the present description.

FIG. 1 illustrates a door assembly 100 including an exemplary embodiment of an acoustic seal system 150 of the present description. The seal system 150 is shown generally with dashed lines in FIG. 1 as its components are hidden from view when the door assembly 100 is in its closed position because the components are provided in or integrally formed with the door assembly 100 components. Each of the seal system 150 components, though, is explained in detail with reference to FIGS. 2-5, which are sectional views of each of the four sides of the right hand (RH) door 140, that are useful for explaining the features of the acoustic seal system 150 as it is provided on both doors 130, 140 (i.e., like components of the seal system 150 are provided on both doors 130 and 140 such that an understanding of the configuration about door 140 will provide understanding of the configuration about door 130).

As shown in FIG. 1, the door assembly 100 includes a wall 110 extending upward vertically from a floor or support platform 104. The wall 110 includes an opening or passageway 112 that is shown to be rectangular in shape but may take other shapes such as arcuate in some cases. On the inner or inward-facing surfaces of the opening/passageway 112 in the wall 110, the door assembly 100 includes a door frame 120 for supporting a left hand door 130 and a right hand door 140 (or first and second doors or a pair of swinging doors or the like). Two doors 130, 140 are shown but the assembly 100 may be implemented with a single door in some embodiments with the acoustic seal system 150. The doors 130, 140 may be configured to open into the page containing FIG. 1, e.g., with hinges or the hinge line provided on the opposite side of the doors 130, 140 shown in FIG. 1 as will be well understood by those skilled in the art.

Note, no astragal is provided in the door assembly 100 such that an air gap or passageway 141 is provided between the doors 130 and 140, and also there is no threshold provided on the floor 104 such that there is another air gap or passageway 143 between the doors 130, 140 and the floor 104. Such air gaps 141, 143 generally are considered problematic in prior contact-based seal systems so previously were avoided but are intentionally provided in the door system 100 with the acoustic seal system 150.

The door frame 120 includes left and right vertical support members 122, 126 and also a horizontal or upper support member 124 extending between upper ends of the two vertical support members 122, 126, with each of these members 122, 124, 126 affixed to mating surfaces of the opening/passageway 112 of the wall 110. Each of the doors 130 and 140 is pivotally coupled to one of the frame support members 122 or 126 to be able to swing open into the paper containing FIG. 1 and to swing back to the closed position shown in FIG. 1. The left door 130 includes a body 132 with a shape (e.g., a rectangular shape) and size to substantially fill one half of the gap/passageway 112 in the wall 110, and the right door 140 likewise has a body 142 with a shape (e.g., a rectangular shape) and size to fill the other half of the gap/passageway 112 in the wall 110.

Typically, a small gap is provided about the periphery of each door 130, 140 such as one that is 0.25 inches or less between adjacent surfaces as is demonstrated with air gaps/passageways 141, 143. The left door 130 has four sides on its body 132 as shown with outer side 134 (proximate to vertical frame support member 122), inner side 136 (near/adjacent door 140 when in closed position), upper side 137 (proximate to upper/horizontal frame support member 124), and lower side 138 (proximate to the floor 104) as does the right door 140 with outer side 144 (proximate to vertical frame support member 126), inner side 146 (near/adjacent door 130 when in closed position), upper side 147 (proximate to upper/horizontal frame support member 124), and lower side 148 (proximate to the floor 104).

To provide sound transmission control, the door assembly 100 includes the acoustic seal system 150. In general, a portion or section of the system 150 is provided in a position in the door assembly 100 such that sound is absorbed throughout the flanking path around the two doors 130, 140. This may involve providing a portion or section of the system 150 on (or embedded in or integrally formed on) each side 134, 136, 137, 138, 144, 146, 147, 148 of the doors 130, 140 and/or providing a portion or section of the system 150 on (or embedded in or integrally formed on) the surrounding structural components such as frame members 122, 124, 126.

With reference to the right hand door 140 (and with reference to the inner side 136 of left hand door 130), the acoustic seal system 150 is shown to include: (a) a first or upper segment (or assembly, portion, or the like) 152 in or on the upper frame support member 124; (b) a second or lower segment (or assembly, portion, or the like) 154 in or on the lower side 148 of the door body 142; (c) a third or outer vertical segment (or assembly, portion, or the like) 156; and (d) a fourth or inner vertical segment (or assembly, portion, or the like) 158. In combination, these segments (and with similar segments provided in system 150 about door 130) allow the acoustic seal system 150 to absorb a significant amount of audio or sound so that it is not transferred through the wall 110 at the doors 130, 140. Each of segments 152, 154, 156, and 158 of the system 150 is described in detail below with reference to FIGS. 2-5.

Figure 2:
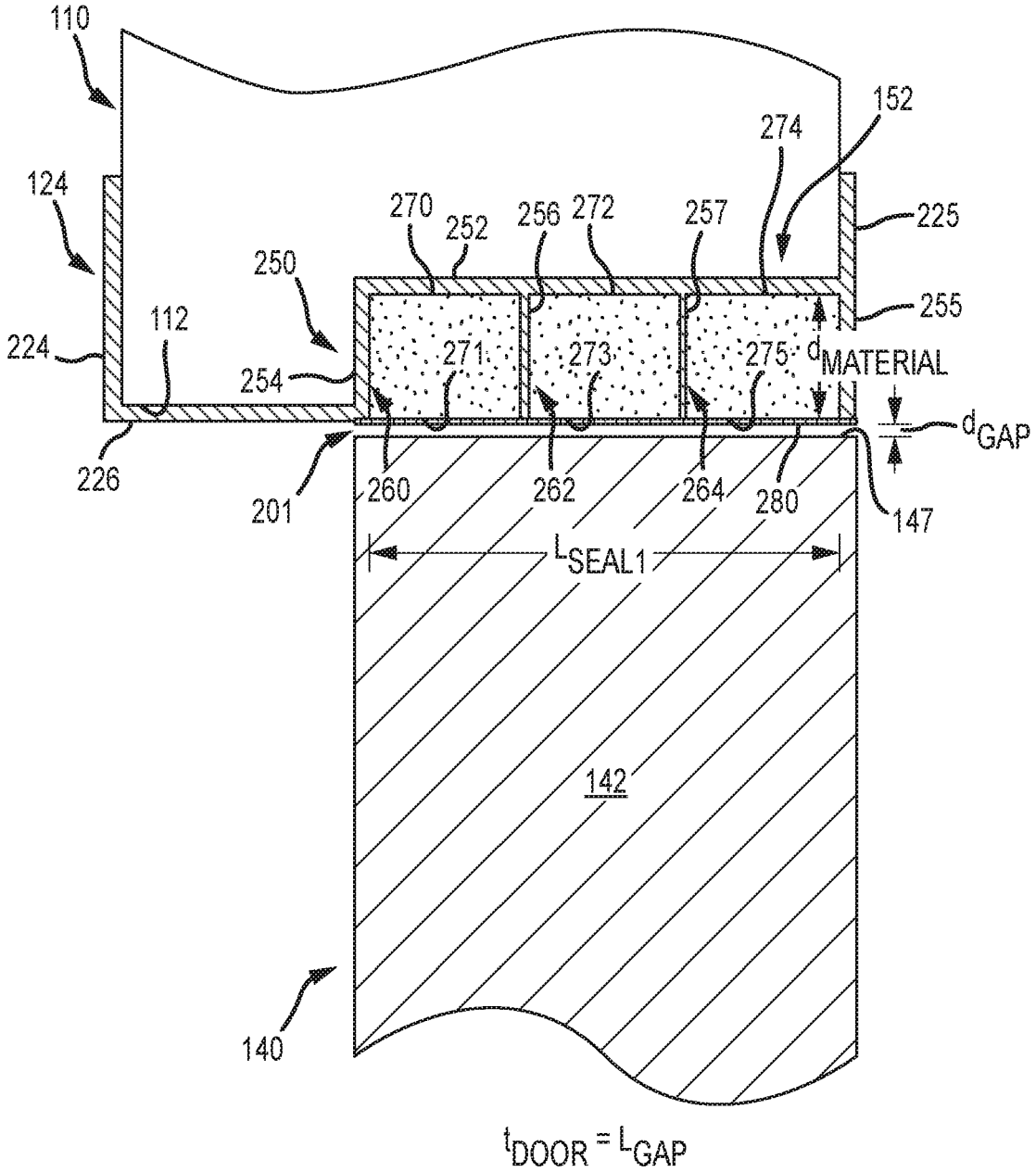
FIG. 2 illustrates a segment of the acoustic seal system of FIG. 1 with a sectional view taken at line A-A that may be considered an alternative embodiment to the embodiment of FIG. 1.

FIG. 2 illustrates the upper segment or assembly 152 of the acoustic seal system 150 of FIG. 1 with a sectional view. As shown, the door body 142 is solid or has a solid structural core to provide a portion of the sound barrier in the wall opening 112 such as with metal core. The body 142 has a thickness, $t_{Door}$, which defines the length, $L_{Gap}$, of the air passageway or gap 201 between an upper side 147 of the door body 142 and the upper or horizontal frame support member 124. The thickness, $t_{Door}$, of the door body 142 may vary to practice the acoustic seal system 150 with greater thicknesses being preferable to achieve a greater amount of sound absorption along the passageway/gap 201 as this provides a longer flanking path along which sound absorption material may be provided (e.g., greater sound absorbing surface area and/or volume of sound absorbing material). In some applications, the thickness, $t_{Door}$, and gap length, $L_{Gap}$, are in the range of 4 to 10 inches with one useful embodiment having a gap length, $L_{Gap}$, of about 8 inches (which may be defined by the door body 142 alone or in combination with decorative cladding that may be mounted onto one or both surfaces of the door body 142 (e.g., see FIG. 3 for an example of a door with added cladding).

The door frame 124 includes first and second vertical sidewalls 224, 225 along with a base 226 extending orthogonally outward from the first sidewalls 224, and these components 224, 225, 226 provide structure for mounting the frame support member 124 to the wall 110 along the section that defines the upper portion of the opening or passageway 112 through the wall 110. Significantly, the segment 152 of the seal system 150 is formed integrally with the frame member 124 or is supported by its features. Particularly, the seal system segment or assembly 152 includes a body or housing 250 with a base 252 extending outward from the frame sidewall 225, and the base is offset a distance, $d_{Material}$, that defines a depth of sound absorption material that can be received within the body/housing 250. The body/housing 250 also is defined by a pair of outer sidewalls 254, 255 that are spaced apart a distance, $L_{Seal1}$, that defines a length of the acoustic seal provided by the segment 152 (i.e., a length of a contact area with material received in the body 250). The body 250 has a length (as measured into the page of FIG. 2) that allows it to extend along the entire (or substantially all with it being useful that a majority of the edge is covered but this is not a requirement) of the length of the door's upper side 147 (and along the upper side 137 of door 130, too), and, in this way, the seal segment 152 is provided along the entire upper edge of the two doors 130, 140 when they are in the closed position.

The sidewalls 254 and 255 along with the base 252 are configured to define a cavity or recessed surface for receiving sound absorbing material, and, in some embodiments, a single cavity or recessed surface is utilized such as the generally rectangular cross sectional shape shown. However, the inventor has determined that it is desirable in some embodiments to divide this cavity up into two or more smaller cavities 260, 262, 264 to achieve more sound absorption. The sidewalls 254, 255 and dividing walls 256, 257 may be made of any rigid or semi-rigid material of weight and thickness sufficient to block sound. It is convenient to utilize a metal such as aluminum or steel with thickness greater than about 0.125 inches since these adequately block sound and offer considerable durability. Some embodiments may utilize a semi-rigid material such as mass-loaded vinyl, rubber, or neoprene with a similar thickness. The semi-rigid materials can potentially be safer for embodiments where a person's fingers could possibly be trapped inside of the joint as the door closes. As shown, a pair of dividing walls 256 and 257 are provided that extend orthogonally away from the base 252 and that are spaced apart a distance from the sidewalls 254, 255 (such as to divide the single large cavity up into three cavities 260, 262, 264 with matching or differing widths with equal widths shown in the non-limiting example of FIG. 2). The dividing walls 256, 257 (and other structural components of the segment 152) may be fabricated from a variety of materials such as a metal (such as a solid steel or aluminum member), and the dividing walls 256, 257 tend to redirect incoming sound to further its absorption by the segment 152.

To achieve sound absorption or attenuation, a volume of sound absorbing material 270, 272, and 274 is positioned into each of the three cavities or recessed surfaces 260, 262, 264 of the body/housing 250. The ends of the cavities 260, 262, 264 may be left open such that the material volumes or pieces 270, 272, 274 each have a contact surface 271, 273, 275 that is exposed to or in fluid communication with the air passageway or gap 201 or, as shown, a protective screen 280 may be placed over the material 270, 272, 274 to physically protect it while still allowing sound to pass freely (or with minimal disruption) to the material 270, 272, 274 (e.g., the screen 280 may take the form of a sheet of perforated metal that is acoustically transparent).

The sound absorbing material used for pieces/volumes 270, 272, 274 may vary to practice the sealing segment 152 (and system 150). For example, the material may be any one of or a combination of foam (e.g., open cell foam (such as an acoustical foam)), fiberglass, mineral wool, and rockwool. In one embodiment, a sound absorbing material tested according to ASTM C423 and found to have a noise reduction coefficient (NRC) greater than 0.5 would be satisfactory for the pieces 270, 272, 274 of sound absorbing material. In other embodiments, a material tested according to ASTM C423 and found to have an NRC greater than 0.9 is used that results in additional sound transmission loss. The depth, $d_{Material}$, of the material volumes/pieces 270, 272, 274 is generally chosen to be in the range of 0.25 to 2 inches or more, with at least 0.25 inches providing absorption of high frequency sound and greater depths such as 1 inch or more to absorb at least a portion of the low frequency sound (and mid frequency) or 2 inches or more functioning effectively to absorb low, mid, and high frequencies. The length of the cavity (or combined lengths of cavities 260, 262, 264) defines the length, LSeal1, of the acoustic seal and absorbing contact surface (see surfaces 271, 273, 275), and this is typically chosen to be at least half of the gap length, $t_{Door}=L_{Gap}$, and, more preferably in the range of 75 to 100 percent of the length, $t_{Door}=L_{Gap}$, to provide greater amounts of sound absorption (or a greater sound transmission loss). In some embodiments, the sound transmission loss of sound passing through the gap/passage way is 3 to 6 dB or more with the use of the seal segment 152 compared to an otherwise untreated passageway.

Figure 3:
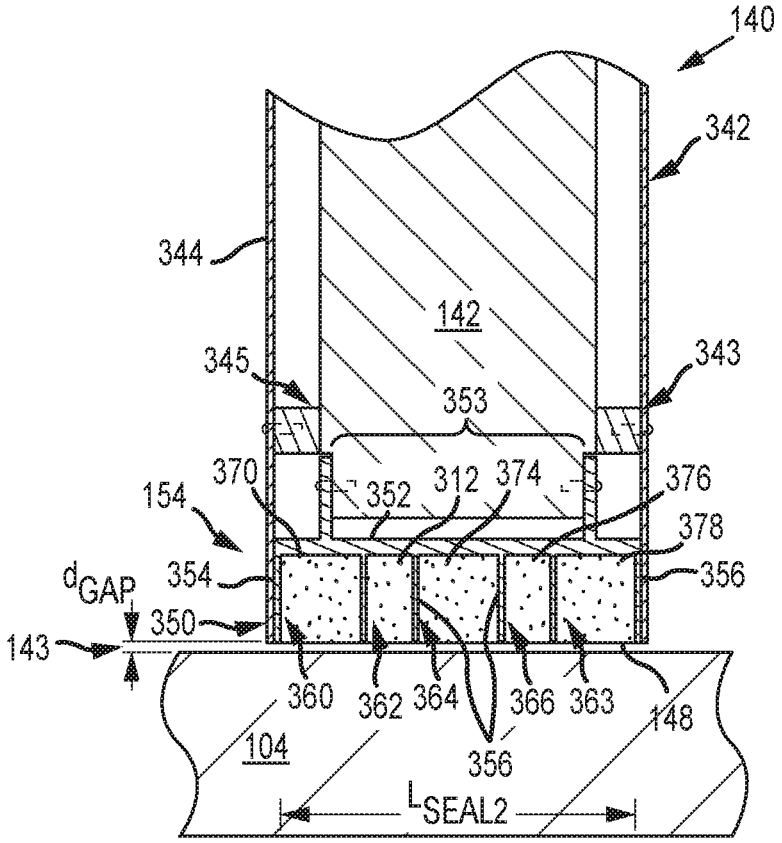
FIG. 3 illustrates a second segment of the acoustic seal system of FIG. 1 with a sectional view taken at line B-B that may be considered an alternative embodiment to the embodiment of FIGS. 1 and 2.

FIG. 3 illustrates a cross sectional view of the door assembly 100 of FIG. 1 taken at line B-B to show the acoustic sealing achieved at the lower side/edge 148 of door 140 (with it being understood that similar sealing is provided at edge 138 of door 130). As shown, the sectional view is useful for showing that the door 140 may include a decorative cladding (or additional outer surface element) 342 and 344 on both its surfaces that are affixed to the structural core/body 142 such as with stand-off devices 343, 345 such that there is a space between the body/core 142 and the cladding 342, 344. The cladding 342, 344 is useful for decorating the door core/body 142 and also increases the length of the gap/passageway 143 between the door's lower side 148 and the floor 104, which is desirable for providing a more sealing length, $L_{Seal2}$. Such cladding 342, 344 may be provided only along the bottom portion of the door 140 or may also be provided at the upper portion. Although not shown, cladding 342, 344 may be provided on the body 142 near upper seal segment 152 of FIG. 2.

Sound absorption is provided along the gap/passageway 143 (0.25-inch distance, $d_{Gap}$, or less in most cases) by the inclusion of the seal system segment 154 that is mounted onto or is embedded into or provided as an integral feature of the door 140. The seal system segment 154 includes a body/housing 350 with a base 352 (e.g., a horizontal planar member) that is mounted, in an adjustable manner, via arms 353 to the bottom edge of the door body 142 within the cladding 342, 344. Note, the body/housing can be moved in an up/down direction to achieve the gap distance, $d_{Gap}$, or less than 0.25 inches. As shown, the base 352 extends the full distance between the cladding elements 342, 344, but it may have a smaller width in some embodiments. The body/housing 350 also includes a pair of outer sidewalls 354, 356 that extend outward (e.g., orthogonally) from the base 352 toward the floor 104 and to the lower side 148 of the door 140. The body/housing 350 also may have a length, as measured into the page of FIG. 3, that matches the length of the lower side 148 of the door 140 (but a smaller length may be acceptable in some applications) so that sound absorption is provided for the entire flanking path along the side 148.

The sidewalls 354 and 356 define, with the base 352, a cavity or recessed surface for receiving sound absorbing material. However, as with the sealing system segment 152, two or more dividing walls or fingers 356 are provided (with four shown in FIG. 3) to divide the cavity up into three or more cavities/recessed surfaces 360, 362, 364, 366, 368 (with five shown). The dividing walls 356 are not equally spaced apart from each other so that the volume of the cavities differs with cavities 360, 364, and 368 being about equal in size and larger than two smaller cavities 362, 366, and the use of a plurality of dividing walls is likely to increase absorption by causing additional bouncing and redirection of sound transferred through the gap 143. Particularly, the walls 356 typically are solid (steel or the like as discussed above) to redirect sound into the cavities 360-368. Pieces or volumes 370, 372, 374, 376, and 378 are inserted into each of the cavities 360-368, with outer surfaces exposed at the side 148 of the door 140 (or in fluid communication with the gap/passageway 143.

As shown, the material 370-378 in cavities 360-368 defines a seal length, $L_{Seal2}$, that typically is more than one half of the door thickness as measured between outer surfaces of the cladding 342, 344 and typically is in the range of 90 to 100 percent of the door thickness to provide as much sound absorption as possible with a particular gap/passageway length. The sound absorbing material may take a form similar to that provided in seal segment 152 or may differ. Additionally, the cavities 360-368 are typically 0.25 to 2 inches or more in depth and the sound absorbing pieces (or volumes) 370-378 are typically provided so as to wholly (or nearly wholly) fill the cavities 360-368 (i.e., have a depth matching that of the cavity in which they are placed).

Figure 4:
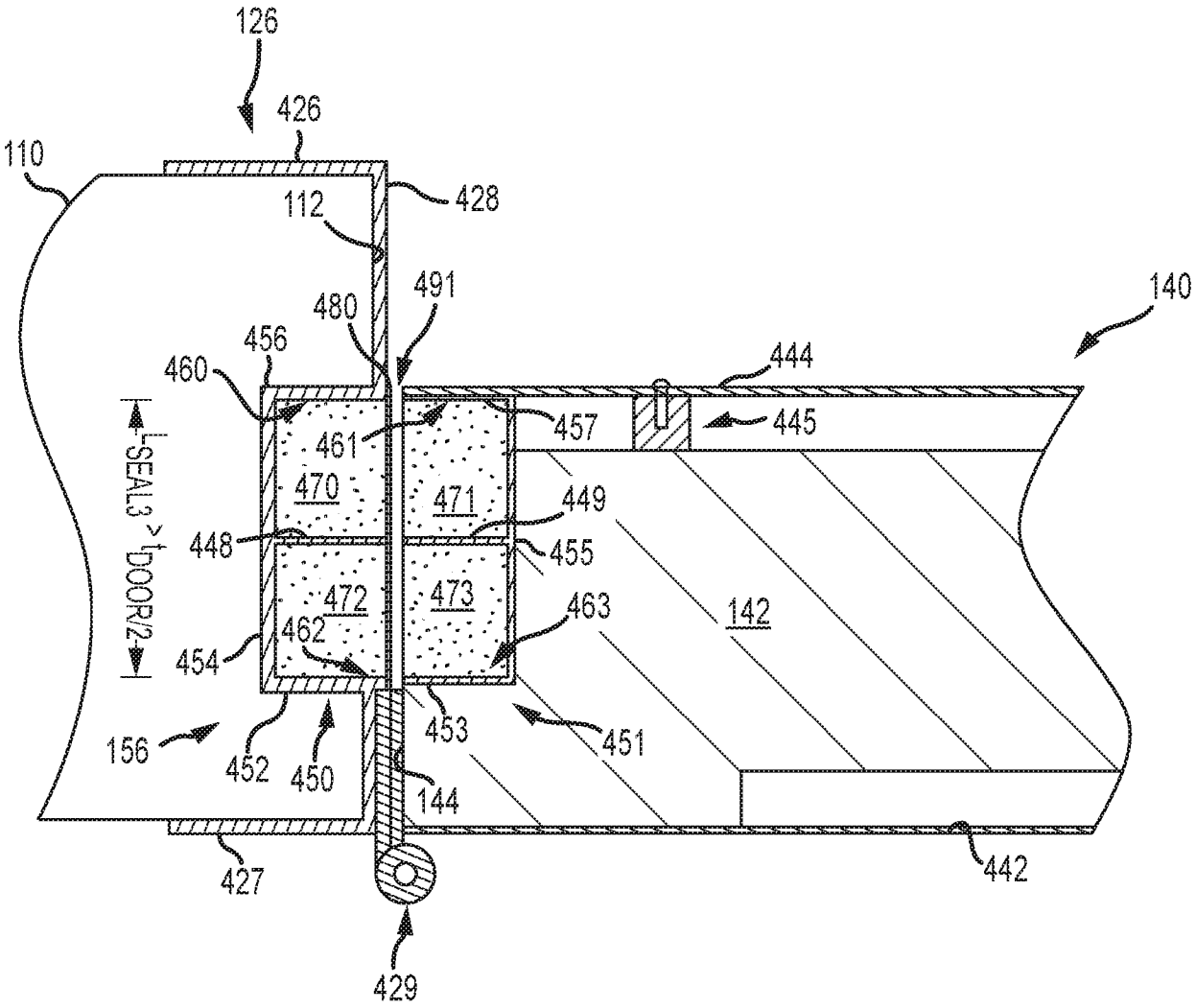
FIG. 4 illustrates a third segment of the acoustic seal system of FIG. 1 with a sectional view taken at line C-C that may be considered an alternative embodiment to the embodiment of FIGS. 1-3.

FIG. 4 illustrates a sectional view of the door assembly 100 of FIG. 1 showing how an embodiment of the acoustic sealing system 150 is used to provide a sound barrier at an outer side/edge 144 of the door 140 (and in a similar fashion at side/edge 134 of the other swinging door 130). As shown, the side frame member 126 is adapted to support or include a portion or half of the side seal segment 156. Particularly, the frame member 126 includes first and second side elements 426, 427 along with a base element 428 extending between the two side elements 426, 427, and these elements 426, 427, 428 of the vertical support member 126 are used to mount the frame or support member 126 of the door frame to the wall 110 along the vertical surface of the opening 112.

The seal segment 156 includes a first body or housing 450 formed as part of or supported by the vertical support member 126 of the door frame. The first body/housing 450 includes a base 454 that is offset from the base 428 of the vertical support member 126 a distance (e.g., 0.25 to 2 inches or more) to provide a space or cavity for receiving sound absorbing material 470, 472. The cavities 460, 462 of the housing/body 450 are further defined by the two spaced apart outer sidewalls 452, 456 and a single dividing wall 448 (positioned centrally between the two sidewalls 452, 456). An acoustically transparent protective screen 480 may be placed over the sound absorbing material to physically protect and retain it place while still leaving the material 470, 472 in fluid communication with the passageway/gap 491 between the wall 110 and the door 140 (again, the gap 491 is typically 0.25 inches or less in length). The length, $L_{Seal3}$, of the seal achieved can be seen to be less than the whole thickness of the door 140 as the hinge 429 provides some blocking of access and blocking of sound but is greater than one half of the door thickness, $t_{Door}$, and gap length.

In this example, the acoustic seal system 150 includes sealing features on both sides of the air passageway/gap 491. To this end, the door 140 is shown to include cladding 442 that is mounted directly onto the side/surface of the door body/core 142 and also to include cladding 444 that is mounted in a spaced apart manner from the core/body 142 with a stand-off device 445. Thus, the cladding 442, 444 defines a larger door thickness and path length, $t_{Door}$, so as to provide more room for sound absorption but not as great of an increase over the core/body 142 as found with the embodiment shown in FIG. 3 (and either cladding approach may be useful as may be the bare door approach found in FIG. 2).

The seal segment 156 includes a second body/housing 451 that is attached to the door core/body 142 and to the cladding 444 (e.g., is embedded into the side 144 of the door 140 and/or is physically supported by the door 140). The second body/housing 451 includes a base 455 that is offset a distance (e.g., 0.25 to 2 inches or more) from the door end/side 144 to provide a cavity with a depth useful for receiving a large enough piece or volume 471, 473 of sound absorbing material in a pair of cavities/recessed surfaces 461, 463 defined by spaced apart sidewalls 453, 457 and dividing wall 449. The cavities/recessed surfaces 461, 463 are located in the door 140 such when the door is in the closed position, as shown in FIG. 4, the cavities/recessed surfaces 461, 463 are directly opposite across the gap 491 from the cavities/recesses surfaces 460, 462 (or such that the sound absorbing material sandwiches/defines the air passageway/gap 451 to absorb sound passing in the gap 491). It is also desirable for dividing walls 448 and 449 to be provided in matching locations along the air gap/passageway 491 since this causes the biggest disruption to sound as it transfers along the gap/passageway 491. The use of two bodies with facing cavities filled with sound absorbing material (such as an open cell foam or the like) may be useful when the flanking path is short (or an obstruction such as a door hinge reduces available space) and/or may be more effective in generating sound transmission loss.

Figure 5:
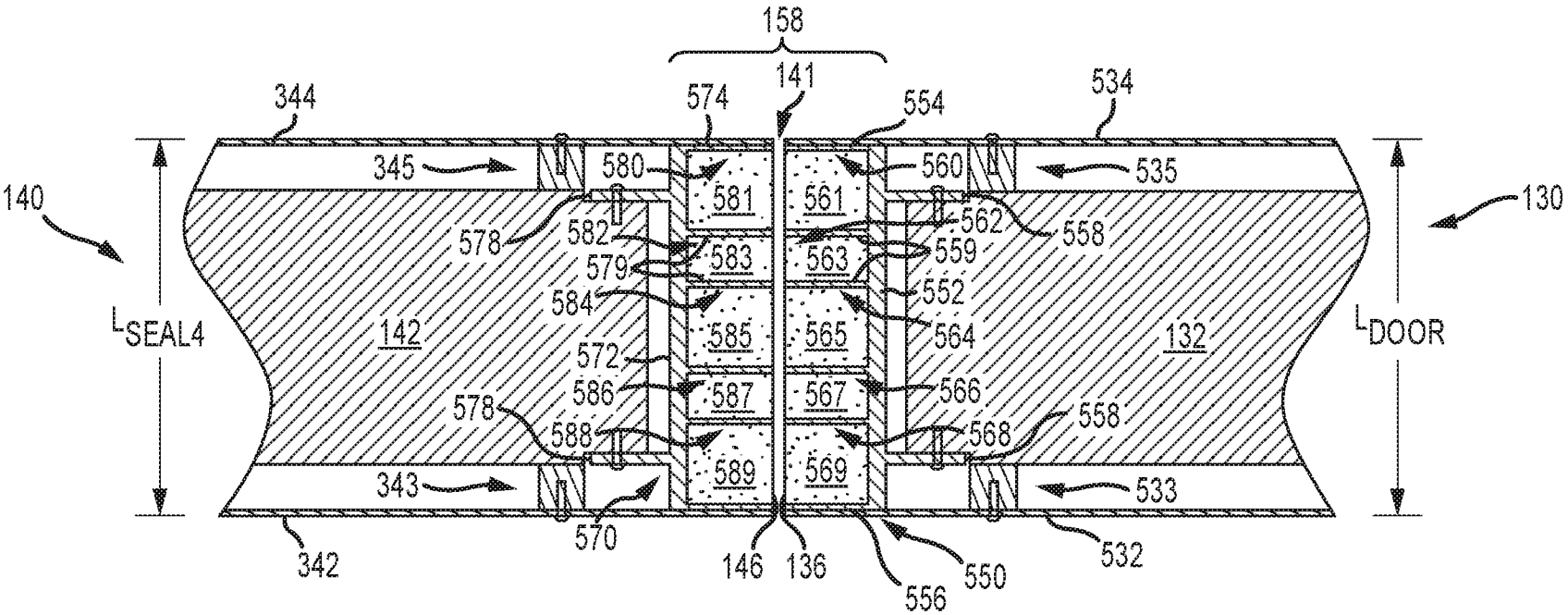
FIG. 5 illustrates a fourth segment of the acoustic seal system of FIG. 1 with a sectional view taken at line D-D that may be considered an alternative embodiment to the embodiment of FIGS. 1-4.

FIG. 5 illustrates a sectional view of the door assembly 100 of FIG. 1 showing how the acoustic seal system 150 is useful for achieving a sound barrier along the flanking path between the two doors 130, 140 when they are in the closed position as shown in FIGS. 1 and 5. The door 140 may take the form shown in FIG. 3 with decorative cladding 342, 344. Similarly, the adjacent or left door 130 may include similar decorative cladding 532, 534 that is affixed to the door body/core 132 with stand-off devices 533, 535 such that the thickness, $t_{Door}$, of the door 130 matches that of door 140 such as in the range of 6 to 10 inches or the like (with some applications using an 8-inch door including the cladding). These thicknesses define the length, $L_{Gap}$, of the air passageway/gap 141 between the inner sides 136, 146 of the closed doors 130, 140.

As with the system segment 156, the seal system segment 158 is configured to position sound absorbing material to face into the gap 141 on both of its sides to better absorb sound/audio transferred in the gap 141. To this end, the segment 158 includes a first body/housing 550 made up of a base 552 offset a distance (e.g., 0.25 to 2 inches or more) from the inner side 136 of the door 130 to define a cavity or space for sound absorbing material. The body 550 is adjustably affixed to the end of the door core/body 132 with arms 558. Particularly, the body 550 includes a pair of spaced apart outer sidewalls 554, 556 extending orthogonally outward from the ends of the base 552 and a number (e.g., 2 to 4 or more) of dividing walls 559, which divide the overall body cavity/recessed surface into a number (here, five are shown) of cavities/recessed surfaces 560, 562, 564, 566, and 568. A piece or volume 561, 563, 565, 567, 569 of sound absorption material is positioned within each of these cavities 560, 562, 564, 566, 568 to be exposed to or facing the air gap 141 when the door 130 is closed and proximate to the other door 140.

Further to provide a two-part seal, the segment 158 includes a second body/housing 570 made up of a base 572 offset a distance (e.g., 0.25 to 2 inches or more) from the inner side 146 of the door 140 to define a cavity or space for sound absorbing material. The body 570 is adjustably affixed to the end of the door core/body 142 with arms 578. Particularly, the body 570 includes a pair of spaced apart outer sidewalls 574, 576 extending orthogonally outward from the ends of the base 572 and a number (e.g., 2 to 4 or more) of dividing walls 579, which divide the overall body cavity/recessed surface into a number (here, five are shown) of cavities/recessed surfaces 580, 582, 584, 586, and 588. Note that bodies 550 and 570 may be moved or adjusted horizontally to enforce a gap less than or equal to 0.25 inches. A piece or volume of sound absorption material 581, 583, 585, 587, 589 is positioned within each of these cavities 580, 582, 584, 586, 588 to be exposed to or facing the air gap 141 when the door 140 is closed and proximate to the other door 130. As shown, the achieved acoustic seal by the combined operation of halves or two parts of the seal segment 158 has a length, $L_{Seal4}$, that is well over one half (e.g., in the range of 90 to 100 percent) of the length of the path 141, which is equal to the door thickness, $t_{Door}$, and sound is absorbed when it travels in gap 141 by material pieces/volumes in both doors 130, 140.

Figure 6:
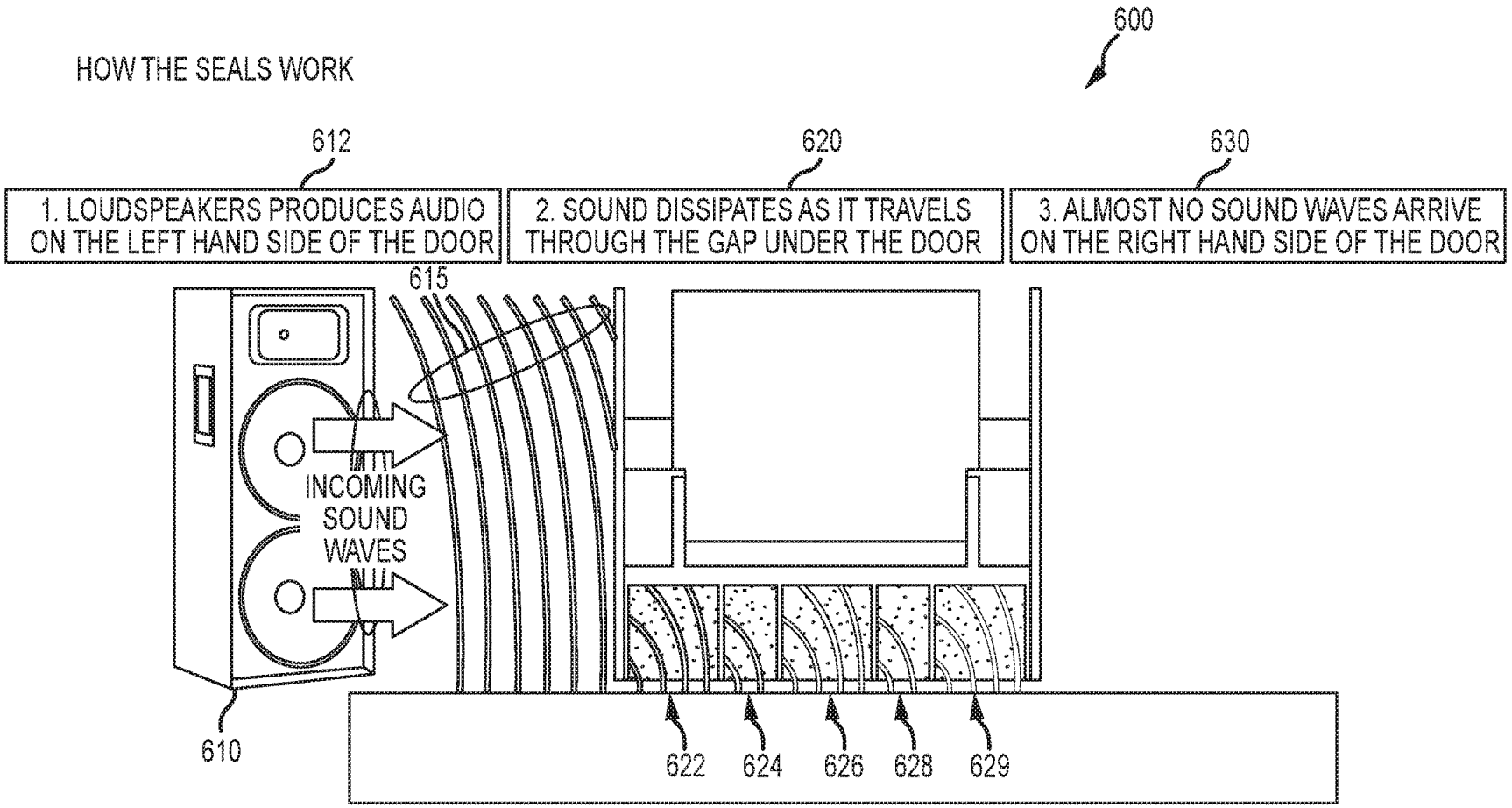
FIG. 6 illustrates a schematic showing operations of the segment of the acoustic sound system shown in FIG. 3 to absorb sound.

FIG. 6 illustrates with diagram or schematic 600 operations of the acoustic sound system according to the present description to limit sound transfer in the flanking paths of the closed doors 130, 140. Particularly, the segment 154 of the system 150 of FIG. 3 is shown during its use to limit transfer of sound in the gap 143 between the door 140 and the floor 104. As shown, a sound system 620 is operated at step 612 to produce audio/sound 615 on one side of the door 140. The sound 615 is shown to be blocked substantially by the door 140 itself (striking cladding 344), but some fraction of the sound 615 enters and is transferred in the flanking path provided by the passageway or gap 143 provided between the lower side 148 of the door 140 and the floor 104.

As shown schematically in FIG. 6, though, step 620 involves the sound dissipating as it travels through the gap 143 under the door 140. Particularly, sound is absorbed or sound transmission losses are generated sequentially by the sound material 370, 372, 374, 376, and 378 in the cavities 360, 362, 364, 366, 368 in the body/housing 350 of the seal segment 154, with the sidewalls/dividing walls 356 assisting in the sound absorption (such as by providing surfaces to bounce the sound 615). As shown at step 630, a reduced amount of the sound waves (e.g., a transmission loss of 3 to 6 dB or more may be typical) arrive on the side of the door 140 in the second room/space separated by the door 140 with the acoustic seal system 150.

While the above sealing segments utilize non-contact seals only, there are applications where it may be desirable to combine or use non-contact seals as taught herein with conventional contact sealing devices to achieve a new acoustic seal system for a door. For example, contact seals may be used in some segments or portions of the acoustic seal system 150 of FIG. 1 (or to provide a sound barrier at some joints/seams) while non-contact seals are used in the other segments or portions of the system 150. In other cases, though, the two types of seal designs are mixed or used in a single door joint or single segment of the system 150. This combination may be useful, for example, for safety purposes to provide a contact seal at each edge or end of the seal segment (such as segment 158 in FIG. 1) to reduce the risks of finger pinch or other dangers associated with a closing door (e.g., have resilient or softer materials such as rubber bulbs or gaskets at the outer edges of a door). This combination is also useful since the absorptive aspect reduces sound leakage that occurs through the contact seal as it becomes worn. Acoustical engineers understand the contact seal will wear and eventually produce an open passageway for noise, which is a condition that will last over a long portion of the door lifespan. In this respect, the mixed absorptive and contact seal arrangement is advantageous because the contact seal can fail with more gradually increasing noise leakage over time.

Figure 7:
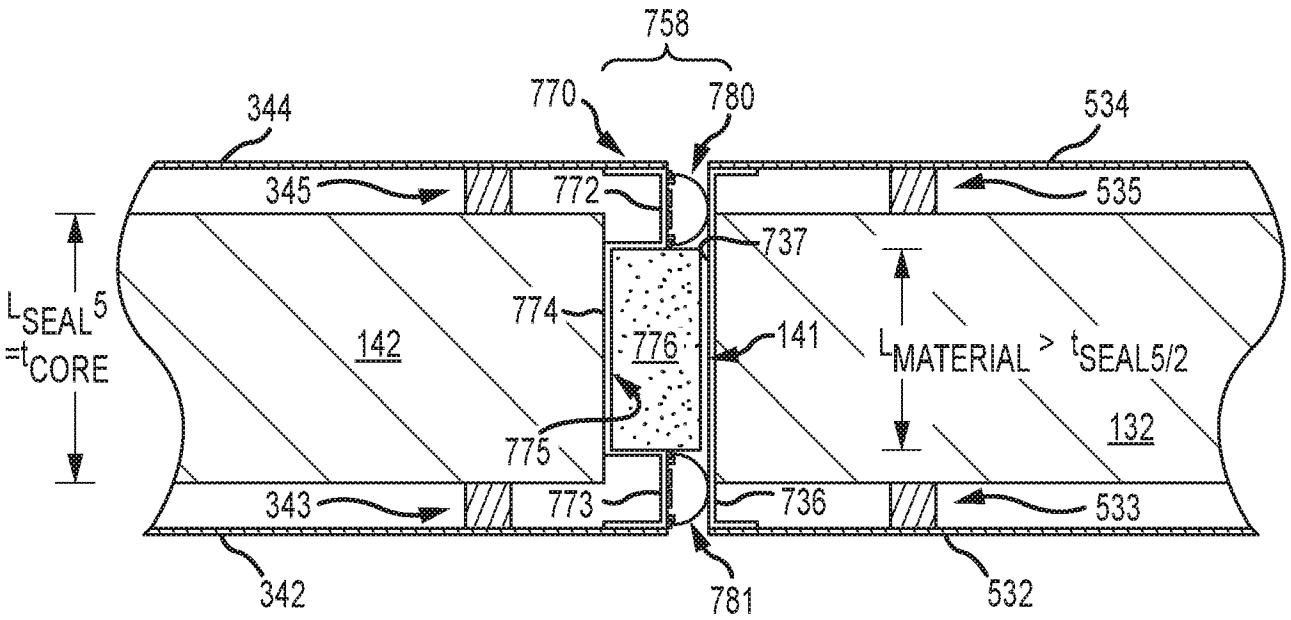
FIG. 7 illustrates another implementation of the fourth segment of the acoustic seal system shown in FIG. 5 that combines contact-based sealing with non-contact acoustic sealing.

FIG. 7 illustrates an implementation that may be used for the fourth segment 158 (with this segment labeled as 758 in FIG. 7 to clarify that it is a different implementation) of the acoustic seal system 150. The segment 758 combines contact-based sealing with non-contact acoustic sealing to achieve an effective sound barrier. If or when sound leaks past the contact seals 780, 781 a volume or piece (or volumes/pieces as taught elsewhere herein) of sound absorbing material as shown at 776 acts to attenuate the leaking sound to limit its transfer through the gap 141 between the two contact seals. Contact seals 780, 781 form a portion of the cavity walls and are unique because they form a semi-rigid or flexible sidewall. These sidewalls may have one or more layers (as the seals appear to block incoming sound with two layers) of flexible material with a thickness and with a material density property resulting in an areal density of at least 0.6 lbs/ft$^2$. More particularly, the material density and thickness can be chosen to provide an areal density of at least 1.8 lbs/ft$^2$ to provide higher effectiveness. Materials such as mass-loaded vinyl, neoprene, natural rubber, PTFE, or silicone rubber would be appropriate for use as or in these sidewalls.

The segment 758 of the seal system 150 is provided on the doors 130, 140 as described with reference to FIG. 5 such that similar components, including cladding 342, 344, 532, 534, is numbered with like reference numbers and is not described in further detail. As shown, the door 130 is modified from the arrangement of FIG. 5 in that an end cap 736 is affixed to the two pieces of cladding 532, 534 and an inner end of the body/core 132 rather than providing a second cavity for receiving sound absorbing material. With this embodiment, a planar surface 737 faces the door 140 when the doors 130, 140 are in the closed position as shown, and the surface 737 of the end cap 736 (e.g., a piece of sheet metal or the like) provides a mating or contact surface for a pair of contact seals 780, 781 to better achieve an airtight seal to block sound.

The door 140 is modified from that shown in FIG. 5 to include a body/housing 770 affixed to the cladding 342, 344 and to the inner end/side of the door body/core 142. The body/housing 770 includes a pair of mounting elements 772, 773 (e.g., L-shaped sheet metal or the like) and a central element 774 with a base and sidewalls to define a cavity/recessed surface 775. A volume or piece 776 of sound absorbing material is positioned and retained in the cavity/recessed surface 775 provided by the body 770. A pair of contact-based seals 780, 781, which may be provided in the form of rubber (or other elastic material) bulb or gaskets and extend the length of the side 146 of the door 140 as does the piece/volume 776 of the sound absorbing material. The sound absorbing material 776 is spaced apart by a gap/passageway 141 from the end cap surface 737 or inner side of door 130 such that any sound leaking past the seals 780, 781 travels over its exposed surface such that at least a fraction of this sound is absorbed.

As shown in FIG. 7, when the doors 130, 140 are in the closed position, the bulbs/gaskets (or other contact-based seal devices) 780, 781 contact the end cap surface 737 to provide a contact-based seal of the gap 141 between the sides/edges of the doors 130, 140. In this embodiment, two contact-based seal elements 780, 781 are provided and the cavity 775 holding the sound absorbing material 776 is sandwiched between the two elements 780, 781 (and is spaced apart a distance from the surface 737 of the door end cap 736 to provide an air passageway/gap 141). Note, there still is a passageway 141 that exists together with the contact seal provided with elements 780 and 781 and that extends in size/length as the seal elements 780 and/or 781 wear (i.e., the passageway 141 then extends over one or both of the elements 780, 781). In other embodiments, though, only one contact-based seal element 780 or 781 may be provided in combination with one or more cavities filled with sound absorbing material 776 (such as open cell foam or the like) to provide an effective segment 758 for an acoustic seal system 150. The contact seals 780, 781 act as sidewalls of the cavity 775 (similar to sidewalls 554 and 556 in FIG. 5).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

Prior to the new non-contact acoustic seal, door seals were of the contacting type, which completely fill the gap between the door and its surrounding entities or structures. The contact seal typically includes a compliant element such as a rubber bulb or gasket. Contact seals function by completely filling the gap/air passage so as to block the gap/air passage so sound is not able to pass or to be transferred between two rooms through the flanking path of a door.

The absorptive door seal taught herein offers a number of advantages over contact-based seals including its simplicity. In some embodiments, there are no contact elements, and, as a result, there are no parts that will wear out or will need to be maintained in contrast to contact-based seals that wear out over time. Therefore, the new acoustic seals likely will reliably function for millions of cycles and will require no maintenance for many years. In many applications, doors open and close thousands of times yearly. Contact-based seals are undesirable for use with these doors as they tend to wear out frequently. For example, the bulbs or gaskets degrade due to the contact abrasion and become leaky to sound over time, which results in lower quality audio and increased maintenance expenses.

Contact-based seals are particularly poorly suited for use at the interface between the door and the floor because they require a threshold to be provided on the floor to provide a surface or location for the contact seal. However, using thresholds can cause problems for vehicles as their wheels must roll over the threshold thousands of times each year. The wheels can become damaged and worn because of the thresholds, which creates the need for additional maintenance and associated expenses. Some doors, though, seal along the bottom edge without a threshold by using a cam lift-type of hinge. Use of cam lift-type hinges can be problematic for automatically opened doors because they require a large opening force, which usually cannot be accommodated within the breakaway safety feature of many door openers. A cam lift-type hinge, hence, requires a door system that is inherently less safe.

Contact seals have also been a problem where double swinging doors meet at their common edge. Swinging pairs of double doors are used where there is a need for a large unobstructed doorway to pass through. To provide an airtight seal of this common edge, one of the doors typically will include an overhanging astragal. The astragal closes the gap between the doors and provides a surface to seal against. However, in order to function properly, the other or non-astragal door must be closed before the astragal door is closed, and this requires specialized and complex mechanisms to enforce this sequentially closing motion. These complex mechanisms increase fabrication or installation costs for the doors and also require additional maintenance.

Some doors are also configured to seal the bottom and common edges without a threshold or astragal by using an automatic seal. Many automatic seals use a mechanical or mechanized system to move a bulb, a gasket, or other contact seal member into contact when the door is closed. While effective in providing a sound barrier, automatic seals are not useful in many settings because they require mechanical linkage and a system of drive components that are complex, expensive, and prone to failure and are also relatively expensive to maintain. With these issues of contact-based acoustic seals in mind, it can be better appreciated that the new acoustic seal systems taught herein are superior to conventional contact-based seals at least because they require: (1) no maintenance; (2) no special mechanical systems to function; and (3) no threshold or astragal.

In some cases, the use of contact-based seals was so problematic that adjustments were made to the audio content presented in the affected rooms to help mitigate sound leaks coming around the doors. For example, the volume level in one room can be increased to help "cover over" sound intrusions that leak around the door from the adjacent room. These audio adjustments are undesirable because the audio quality is usually degraded. With the use of the non-contact acoustic seals of the present description, audio adjustments can be avoided, which helps to promote higher audio quality and a higher quality experience for those in the room.

Additionally, the figures provide examples of how the new acoustical seal system can be used in swinging doors, but the seal concepts are also readily applicable to other doors such as doors that slide open and closed similar to operations of a guillotine. Such sliding door arrangements are not shown specifically in the figures but are believed fully enabled with this description and covered by the following claims.

From the above description, it is clear that a number of embodiments of a door system are taught that may be useful in a variety of applications. In brief, a door system is described that provides sound absorption in flanking paths. The door system includes an opening in a wall and also includes a moveable door positionable within the opening. The door when in a closed position defines an air passageway between an edge of the door and an edge of the opening. The door system further includes at least one cavity facing the air passageway and sound absorbing material positioned in the cavity. In many cases, the sound absorbing material is provided at a depth of at least 0.25 inches in the cavity (such as 2 inches or more), and the cavity has a length greater than half a length of the air passageway measured along the edges of the door and the opening.

In some implementations, the opening extends upward from a floor, and the air passageway is provided between the edge of the door and the floor. In the same or other implementations, the door system further includes a second movable door positionable within the opening, and, with both of the doors in a closed position, the air passageway is defined between the edge of the door and an edge of the second door, with the cavity is provided in at least one of the edges. In one of these implementations or a separate implementation, the door system further includes a door frame defining the opening in the wall, and the edge of the opening is provided by the door frame. In such cases, the cavity (or cavities) is provided in at least one of the edge of the door and the edge of the opening provided by the door frame.

In any of the above embodiments or implementations, the sound absorbing material may be at least one of open cell foam, acoustical foam, fiberglass wool, mineral wool, rockwool, cotton wool, sprayed cellulose, aramid wool, cementitious wood fiber panel, and acoustical plaster. Further, the sound absorbing material may be chosen to have a noise reduction coefficient (NRC) of at least 0.5 when tested according to ASTM C423. Also, the cavity includes at least one divider wall dividing the cavity into two or more spaces for receiving the sound absorbing material, and the at least one divider wall may have a solid body. In some cases, the door system will be configured to include, adjacent to the cavity, a contact-type acoustic seal member providing a contact-based seal with the door in the closed position. Also, the cavity may have a sidewall formed of a semi-rigid material, e.g., at least one of natural rubber, neoprene, mass-loaded vinyl, PTFE, and silicone rubber.

I claim:

1. A door assembly adapted for sound absorption, comprising:

a door pivotally supported on a wall to be positionable in an opened position and in a closed position;

a door frame including an upper member extending along an upper side of the door between the wall and the upper side of the door and further including a side member extending along an outer side of the door between the wall and the outer side of the door; and an acoustical seal system including:

a first air passageway between the upper member of the door frame and the upper side of the door;

a second air passageway between the side member of the door frame and the outer side of the door;

a first housing in at least one of the upper member of the door frame and the upper side of the door, wherein the first housing includes a cavity in fluid communication with the first air passageway;

a second housing in at least one of the side member of the door frame and the outer side of the door, wherein the second housing includes a cavity in fluid communication with the second air passageway;

a first volume of sound absorbing material positioned in the cavity of the first housing; and a second volume of sound absorbing material positioned in the cavity of the second housing, wherein the cavities in the first and second housings each has a depth that is greater than 2 inches, and wherein the second housing is provided in the door frame and the door assembly further comprises a third housing in the outer side of the door with a cavity containing sound absorbing material in fluid communication with the second air passageway.

2. The door assembly of claim 1, wherein the sound absorbing material comprises at least one of open cell foam, acoustical foam, fiberglass wool, mineral wool, cotton wool, sprayed cellulose, aramid wool, cementitious wood fiber, and acoustical plaster.

3. The door assembly of claim 1, wherein the first and second air passageways have a depth as measured orthogonal from the sound absorbing material of less than about 0.25 inches.

4. The door assembly of claim 1, wherein the first cavity has a length as measured along a longitudinal axis of the upper side of the door that is greater than one half of a length of the first air passageway and wherein the second cavity has a length as measured along a longitudinal axis of the outer side of the door that is greater than one half of a length of the second air passageway.

5. The door assembly of claim 1, wherein the acoustical seal system generates sound transmission losses in the range of 4 to 8 decibels.

6. The door assembly of claim 1, wherein each of the first and second cavities includes two or more spaced-apart dividing walls each with a solid body dividing the sound absorbing material into three or more volumes or pieces.

7. The door assembly of claim 1, further comprising a fourth housing mounted to a lower side of the door, wherein the fourth housing comprises at least one cavity filled with a volume of sound absorbing material and wherein the at least one cavity faces a third air passageway between the door and a floor below the door.

8. The door assembly of claim 1, further comprising a second door pivotally mounted to the wall to be positionable in a closed position whereby an inner side of the second door faces an inner side of the door with a third air passageway between the door and the second door and wherein at least one of the inner sides of the door and second door includes a cavity, filled with sound absorbing material, that is in fluid communication with the third air passageway.

9. The door assembly of claim 1, further comprising, adjacent to the cavity in the first or second housing, a contact-type acoustic seal member providing an airtight seal of the first or second air passageway with the door in the closed position.

10. A door system with sound absorption in flanking paths, comprising:

a door frame provided in an opening in a wall extending upward from a floor;

a pair of swinging doors hung in the door frame, wherein an air passageway is provided between each joint between sides of the doors and the door frame, between an adjacent pair of the sides of the doors, and between the sides of the door and the floor;

extending along at least half of the length of the each of the air passageways, a cavity facing a corresponding one of the air passageways; and sound absorbing material at a depth of at least 0.5 inches positioned in each of the cavities, wherein a first subset of the cavities is provided in housings on the door frame and a second subset of the cavities is provided in housings attached to one or more of the sides of the doors.

11. The system of claim 10, wherein the sound absorbing material comprises at least one of open cell foam, acoustical foam, fiberglass wool, mineral wool, rockwool, cotton wool, sprayed cellulose, aramid wool, cementitious wood fiber panel, and acoustical plaster.

12. The system of claim 10, further comprising, at least along one of the air passageways, a second cavity, containing a volume of sound absorbing material, positioned opposite and facing the one of the air passageways.

13. The system of claim 10, wherein individual ones of the cavities include at least one solid dividing wall dividing the cavity into two or more subcavities each containing a volume of the sound absorbing material.

14. The system of claim 10, wherein individual ones of the cavities include semi-rigid sidewalls redirecting sound.

15. The system of claim 10, wherein the sound absorbing material has a noise reduction coefficient (NRC) of at least 0.5 when tested according to ASTM C423.

16. A door assembly adapted for sound absorption, comprising:

a door pivotally supported on a wall;

a door frame including an upper member extending along an upper side of the door between the wall and the upper side of the door and further including a side member extending along an outer side of the door between the wall and the outer side of the door; and an acoustical seal system including:

a first air passageway extending linearly between the upper member of the door frame and the upper side of the door;

a second air passageway extending linearly between the side member of the door frame and the outer side of the door;

a first housing in at least one of the upper member of the door frame and the upper side of the door, wherein the first housing includes a cavity in fluid communication with the first air passageway;

a second housing in at least one of the side member of the door frame and the outer side of the door, wherein the second housing includes a cavity in fluid communication with the second air passageway;

a first volume of sound absorbing material positioned in the cavity of the first housing;

a second volume of sound absorbing material positioned in the cavity of the second housing; and a third housing mounted to a lower side of the door, wherein the third housing comprises at least one cavity filled with a volume of sound absorbing material and wherein the at least one cavity faces a third air passageway between the door and a floor below the door, wherein the door assembly further comprises a second door pivotally mounted to the wall to be positionable in a closed position whereby an inner side of the second door faces an inner side of the door with a fourth air passageway between the door frame and the second door, and wherein at least one of the inner sides of the door and second door includes a cavity, filled with sound absorbing material, that is in fluid communication with the fourth air passageway.

17. The door assembly of claim 16, wherein the sound absorbing material comprises as least one of open cell foam, acoustical foam, fiberglass wool, mineral wool, rockwool, cotton wool, sprayed cellulose, aramid wool, cementitious wood fiber, and acoustical plaster and further wherein the cavities each have a depth that is greater than about 0.25 inches.

18. The door assembly of claim 16, wherein each of the cavities includes two or more spaced-apart dividing walls each with a solid body dividing the sound absorbing material into three or more volumes or pieces.

19. The door assembly of claim 18, wherein at least one of the dividing walls is formed of flexible or semi-rigid material.

20. The door assembly of claim 16, wherein the at least one cavity has semi-rigid or flexible sidewalls.

21. A door system with sound absorption in flanking paths, comprising:

an opening in a wall;

a moveable door positionable within the opening, wherein the door when in a closed position defines an air passageway between an edge of the door and an edge of the opening;

at least one cavity facing the air passageway; and sound absorbing material positioned in the cavity, wherein the cavity includes at least one divider wall dividing the cavity into two or more spaces for receiving the sound absorbing material, and wherein the at least one divider wall has a solid body.

22. The door system of claim 21, wherein the sound absorbing material is provided at a depth of at least 0.25 inches in the cavity and wherein the cavity has a length greater than half a length of the air passageway measured along the edges of the door and the opening.

23. The door system of claim 22, wherein the depth is at least 2 inches.

24. The door system of claim 21, wherein the opening extends upward from a floor and wherein the air passageway is provided between the edge of the door and the floor.

25. The door system of claim 21, further comprising a second movable door positionable within the opening and wherein, with both of the doors in a closed position, the air passageway is defined between the edge of the door and an edge of the second door and wherein the at least one cavity is provided in at least one of the edges.

26. The door system of claim 21, further comprising a door frame defining the opening in the wall, wherein the edge of the opening is provided by the door frame and wherein the at least one cavity is provided in at least one of the edges of the door and the edge of the opening provided by the door frame.

27. The system of claim 21, wherein the sound absorbing material comprises at least one of open cell foam, acoustical foam, fiberglass wool, mineral wool, rockwool, cotton wool, sprayed cellulose, aramid wool, cementitious wood fiber panel, and acoustical plaster.

28. The system of claim 21, wherein the sound absorbing material has a noise reduction coefficient (NRC) of at least 0.5 when tested according to ASTM C423.

29. The system of claim 21, further comprising, adjacent to the cavity, a contact-type acoustic seal member providing a contact-based seal with the door in the closed position.

30. The system of claim 21, wherein the cavity has a sidewall formed of a semi-rigid material.

31. The system of claim 30, wherein the semi-rigid material is at least one of natural rubber, neoprene, mass-loaded vinyl, PTFE, and silicone rubber.

* * * * *